US005870871A

United States Patent [19]

Stewart

[11] Patent Number: 5,870,871

[45] Date of Patent: Feb. 16, 1999

[54] SUMP LINER AND METHOD OF INSTALLATION

[75] Inventor: David Stewart, West Chester, Pa.

[73] Assignee: Total Containment, Inc., Oaks, Pa.

[21] Appl. No.: 810,067

[22] Filed: Mar. 4, 1997

[51] Int. Cl.[6] ..... F65B 1/26

[52] U.S. Cl. ..... 52/515; 52/574; 52/514.5; 52/169.6; 52/169.14; 52/20; 52/741.4; 52/245; 156/94; 405/303; 405/151; 405/152; 427/140; 29/402.15; 29/402.18

[58] Field of Search ..... 156/92, 94; 427/140; 29/402.09, 402.14, 402.15, 402.18; 137/315; 52/514, 514.5, 515, 19, 245, 20, 169.6, 169.14, 741.14; 405/150.1, 150.2, 151–153, 303

[56] References Cited

U.S. PATENT DOCUMENTS 4,976,290 12/1990 Gelin et al. ..... 138/141
5,102,263 4/1992 Allen et al. ..... 405/153
5,106,440 4/1992 Tangeman ..... 156/94
5,405,218 4/1995 Hyde-Smith ..... 405/303
5,490,744 2/1996 McNeil ..... 405/303
5,608,998 3/1997 Hume ..... 52/245

*Primary Examiner*—Robert Canfield
*Attorney, Agent, or Firm*—Panitch Schwarze Jacobs & Nadel, P.C.

[57] ABSTRACT

This invention includes repair of an existing underground sump without the need for costly and time consuming excavation. A plurality of liner-forming pieces are placed inside the underground sump to create a liner preferably substantially conforming to the interior dimensions of the sump. The pieces are joined together to form a unitary containment shell by first taping and then using fiberglass cloth and fiberglass resin. A layer of gel-coat is applied to the surface of the shell to create a fluidtight containment chamber within the sump. Some of the liner-forming pieces can have openings formed therein to accommodate the pipe entries corresponding to those in the sump.

15 Claims, 3 Drawing Sheets

FIG. 3
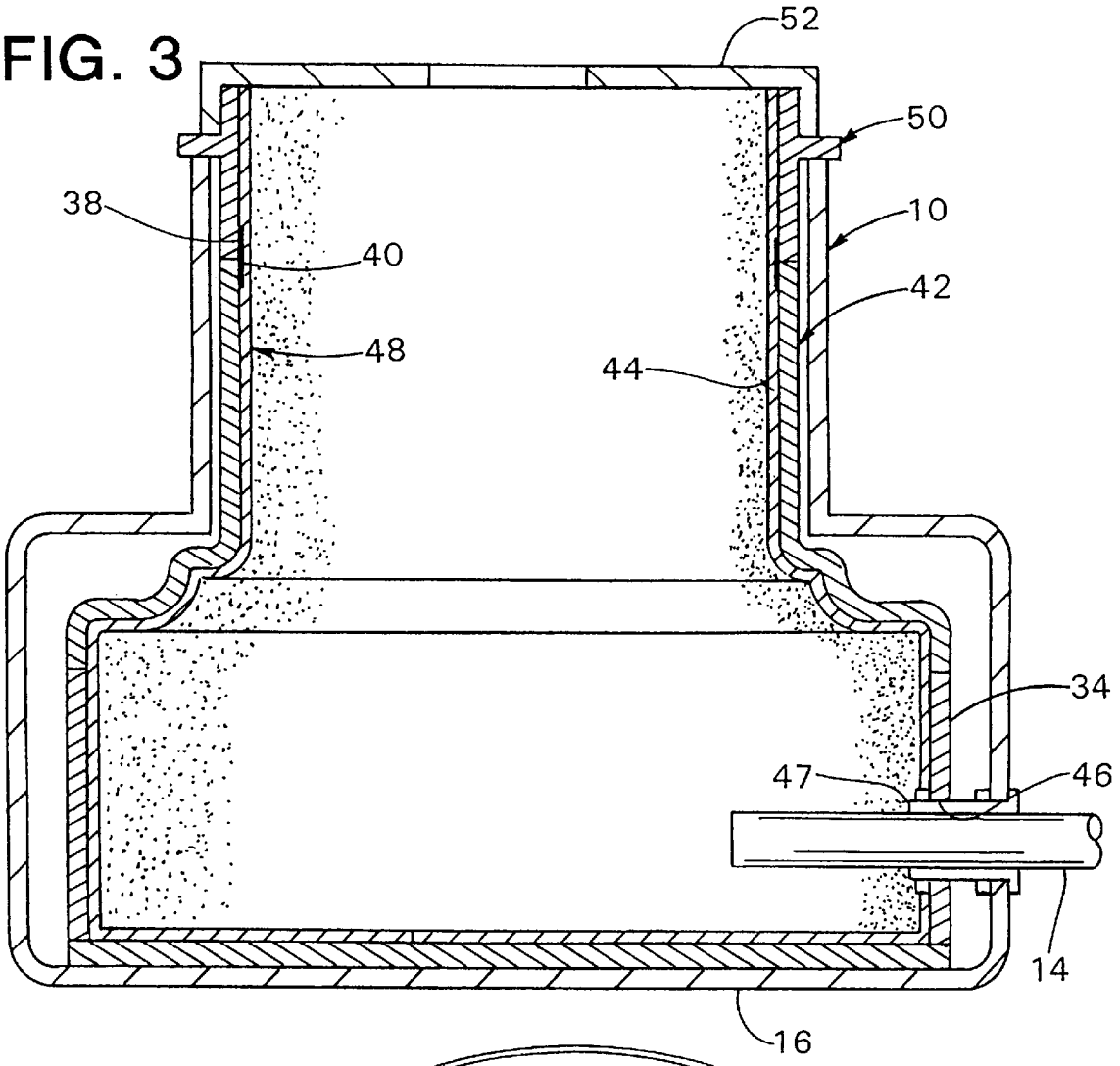
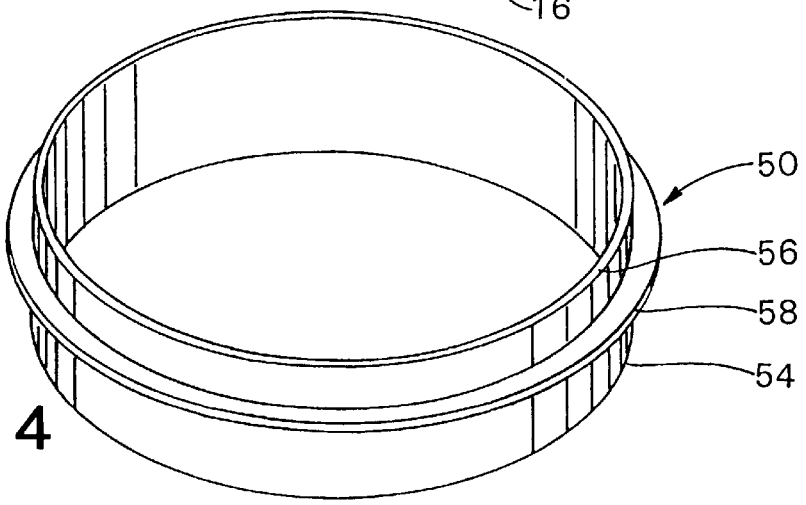
FIG. 4

SUMP LINER AND METHOD OF INSTALLATION

FIELD OF THE INVENTION

This invention relates to underground piping systems and in particular to a sump liner and method of installation of the liner for repairing an underground sump without the need for costly and time consuming excavation.

BACKGROUND OF THE INVENTION

Sumps are widely used in the field of secondary containment for the underground transfer of hazardous fluids, for example gasoline. Sumps are commonly placed on top of the fluid storage tank and beneath a manhole cover in gas stations, such sumps are commonly referred to as tank sumps. The tank sumps form an access chamber and in a pressure system house a portion of a pump and associated piping fittings. In a suction system, the tank sump does not house a pump but will typically include fuel piping. The sump generally has through-wall openings to permit the passage of pipes going into the tank and through the sidewall of the sump. These openings may have gaskets or bulkhead fittings to form a fluidtight seal about the pipe and prevent ground water from leaking into the sump and hazardous fluid from escaping into the environment.

From time to time, these sumps may develop leaks due to ground movement, improper installation, or degradation of seals from microbial action, etc. Prior efforts at remedial action generally involved: (i) excavation of a six-by-six foot area down to the top of the fluid storage tank; (ii) complete removal of the existing sump; and (iii) installation of a new sump. This type of remedial action is labor intensive, time consuming and expensive.

In view of the foregoing, there is a need for repair of an existing sump without excavation. The present invention provides a novel and unobvious method and apparatus for satisfying this existing need in the secondary containment industry.

SUMMARY OF THE INVENTION

This invention includes repair of an existing sump without excavation. A plurality of liner-forming pieces are placed inside the sump to create a liner preferably substantially conforming to the interior dimensions of the sump. The pieces are joined together to form a unitary containment shell by first taping and then using fiberglass cloth and fiberglass resin. A layer of gel-coat is applied to the surface of the shell to create a fluidtight containment chamber within the sump. Some of the liner-forming pieces may have openings formed therein to accommodate the pipe entries corresponding to those in the sump. Any such openings are sealed by conventional gaskets or bulkhead fittings.

Accordingly, it is an object of the invention to create a fluidtight liner for an existing sump that can be installed without excavation.

Another object of the invention is to provide a method of installation of the liner without excavation.

It is further an object of this invention to provide a new liner and method for repair of an existing sump without excavation, the liner of this invention and its method of installation having one or more of the novel features of this invention as set forth above or hereinafter shown or described.

Other objects, uses and advantages of this invention are apparent from a reading of this description which proceeds with reference to the accompanying drawings forming a part thereof.

BRIEF DESCRIPTION OF THE DRAWINGS

The invention will now be described by way of example only and with reference to the accompanying drawings wherein:

FIG. 3 is a sectional view of the sump with the new liner installed; and

FIG. 4 is a perspective view of the cover support ring.

DESCRIPTION OF THE PREFERRED EMBODIMENT

Figure 1:
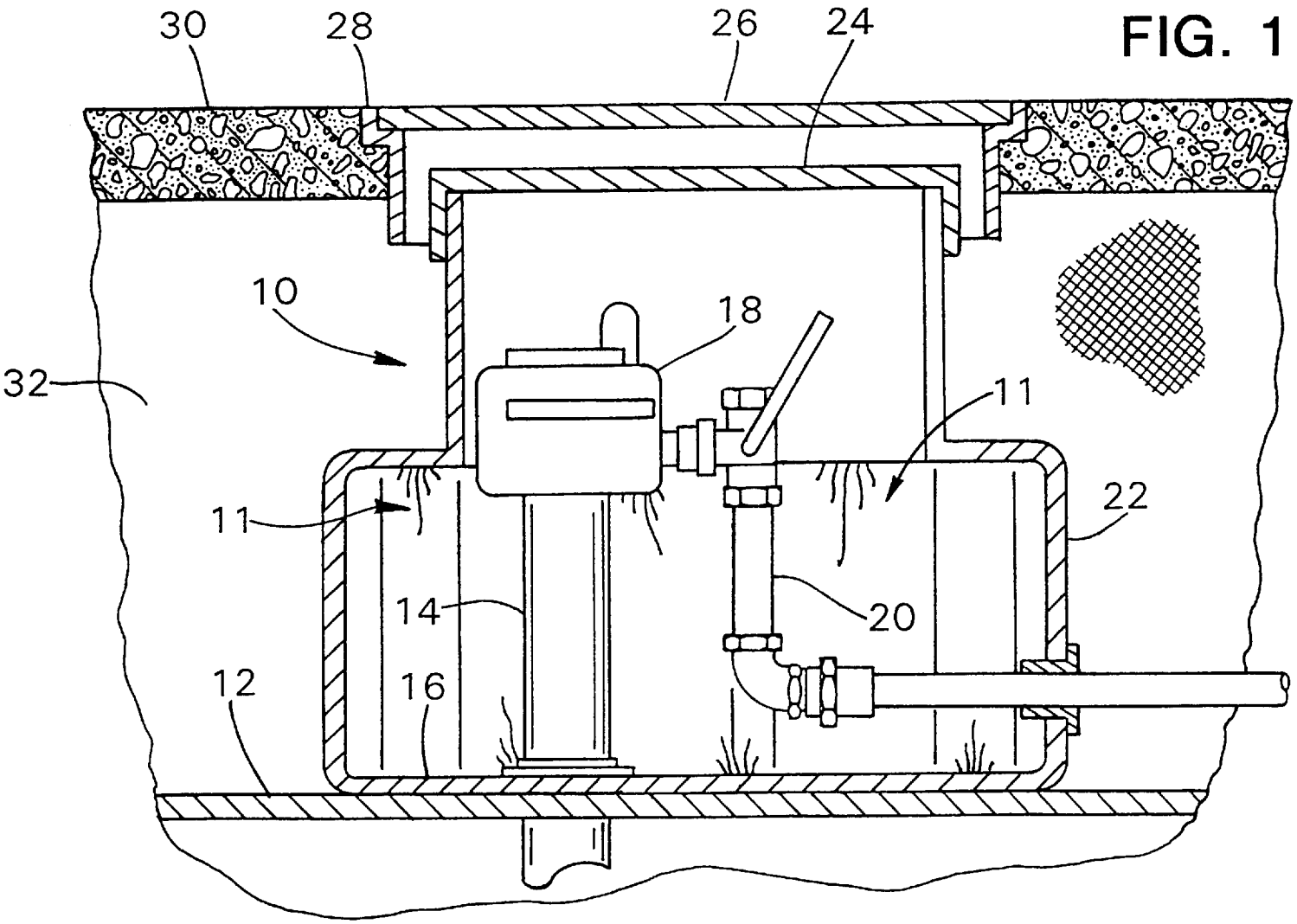
FIG. 1 is a cross-sectional view of an installed sump in need of repair.

FIG. 1 is a sectional view showing an installed sump 10 in need of repair at areas 11 which represent cracks or other imperfections. A tank sump 10 is usually constructed of fiberglass, polyethylene or steel and is used to help prevent the escape of fluids such as gasoline into the environment. Sump 10 is mounted on a fluid storage tank 12. A pipe 14 extends through the bottom wall 16 of sump 10 and connects to a pump head 18. A second pipe 20 connects to pump head 18 and extends through sump sidewall 22. Sump 10 includes a cover 24. As can be seen in FIG. 1, the sump 10 is installed beneath a manhole cover 26. The manhole cover 26 sets within a manhole ring 28 embedded in the pavement 30. The sump 10 is surrounded by soil 32.

Figure 2:
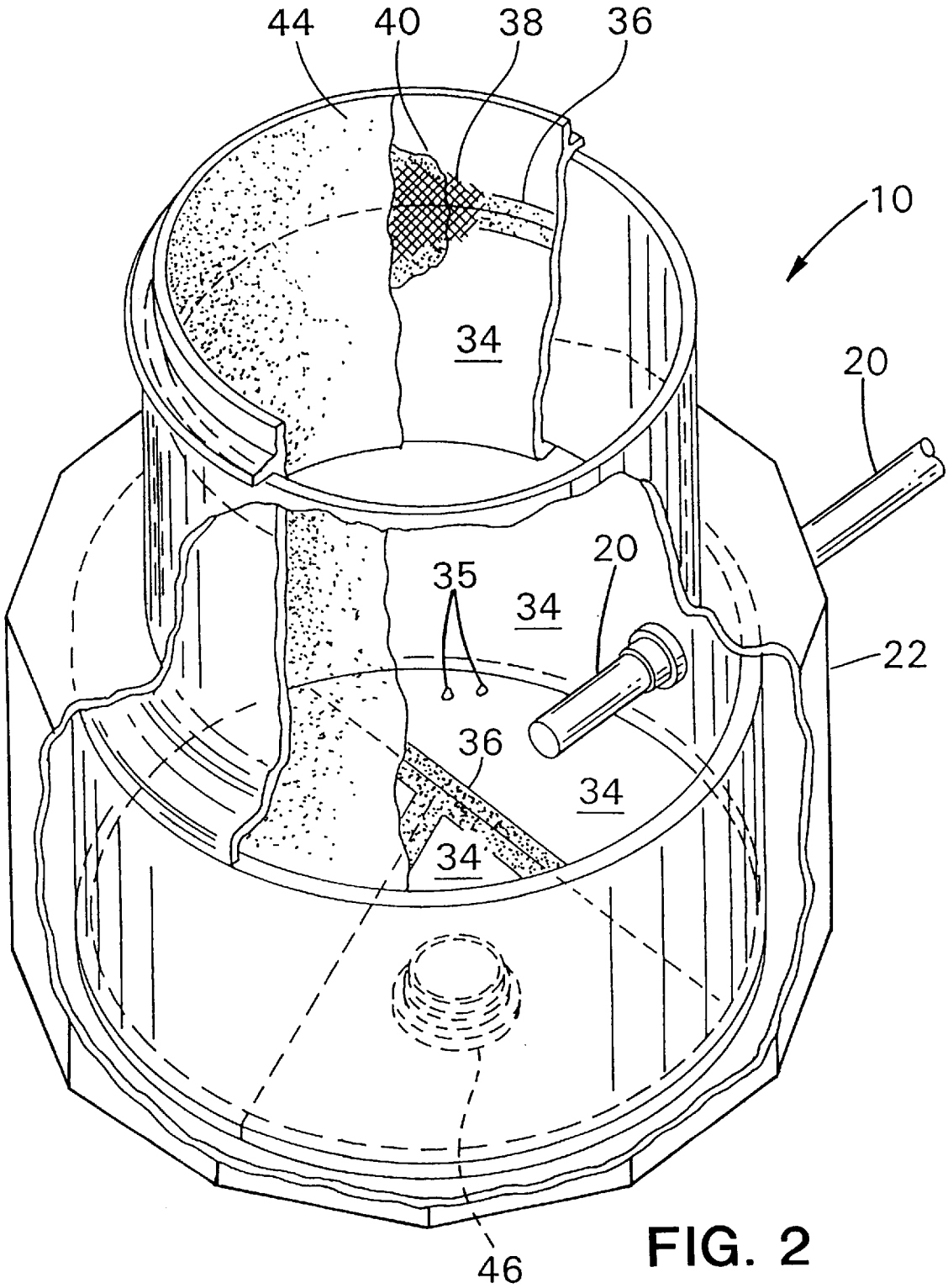
FIG. 2 is a perspective view looking into the open top of the sump under repair illustrating the placement of liner-forming pieces within the sump.

Now referring to FIG. 2, the sump 10 is being repaired by placing liner-forming pieces 34 inside the sump 10. However, before installing the liner it is preferable to remove the pump head 18 and the associated piping. It may be necessary to affix the liner-forming pieces 34 to the bottom wall 16 and sidewall 22 through the use of fasteners such as screws 35. It shall be readily understood that other fastening devices may be used as long as the pieces 34 are properly secured. The liner-forming pieces 34 are then joined together preferably by tape 36. Tape 36 may be common duct tape, for example. Then preferably using fiberglass cloth 38 and fiberglass resin 40, the liner-forming pieces 34 are secured together to form a unitary containment shell 42 within the interior of sump 10. (See FIG. 3). Preferably three layers of the fiberglass cloth 38 and fiberglass resin 40 are applied. This unitary containment shell 42 acts as the containment chamber to prevent leaks from the pump head 18 or the associated piping from escaping into the environment through areas 11 in tank sump 10. Any leak detector present in existing sump 10 should be removed and reinstalled inside of the unitary containment shell 42. After the resin 40 has hardened, a gel-coat layer 44 is applied to the interior of the shell 42.

Gel-coat layer 44 is preferably an unsaturated polyester resin, however any suitable material having the physical and chemical characteristics of being resistant to the effects of gasoline or other hazardous fluid being transferred would be appropriate. It should also be understood that the gel-coat layer 44 may be omitted in those instances where its use is not desired or unnecessary.

It should be understood that individual liner-forming pieces 34 may have holes formed therein to allow the passage of pipes therethrough. Any such holes are sealed by conventional means. For example, a conventional seal 47 may be placed on pipe 20 to prevent fluid passage through hole 46.

Preferably, the liner-forming pieces 34 may be obtained by cutting up a preformed fiberglass sump (not shown) of similar dimension to the interior of sump 10. However, it should be understood that other suitable materials having the required structural and chemical characteristics may also be used. It should be noted that while the liner-forming pieces 34 in this preferred embodiment are formed of fiberglass, other suitable materials which are bondable in a like manner may be employed for the shell 42.

Referring to FIG. 3, a sectional view is shown of a completed liner 48 formed within the sump 10. As shown in cross-section, the liner 48 is multilayered and includes the shell 42, the fiberglass cloth 38, resin 40 and the gel-coat 44. Also, as shown in FIG. 3, the cover support ring 50 is bonded at the top of shell 42 and supports a cover 52. FIG. 4 is a perspective view of the cover support ring 50 showing a downwardly extending flange 54 and an upwardly extending flange 56. A generally horizontally extending flange 58 protrudes outwardly and forms a seat for cover 52.

Thus, this invention not only provides a liner for repair of a sump without excavation, but also this invention provides a new method of making such a liner or the like. It should be noted that the preferred embodiment refers to the repair of a tank sump in a pressure system, i.e., a sump housing a pump and mounted on top of an underground storage tank. The subject invention can be readily used to repair: (i) tank sumps used in suction systems; (ii) junction sumps used in either pressure or suction systems; or (iii) dispenser sumps used in either pressure or suction systems.

While this invention has been described as having a preferred design, it is understood that it is capable of further modifications, uses and/or adaptions of the invention following in general the principle of the invention and including such departures from the present disclosure as come within the known or customary practice in the art to which the invention pertains and as may be applied to the central features hereinbefore set forth, and fall within the scope of the invention and the limits of the appended claims.

What is claimed is:

1. An assembly including a sump and an interior liner, said assembly comprising:

a) a sump having sidewalls and forming part of an underground piping system and having an opening in one said sidewall for permitting passage of a pipe;

b) a plurality of liner-forming pieces joined together within said sump;

c) at least one of said liner-forming pieces having an opening therein for permitting passage of a pipe; and d) whereby said plurality of liner-forming pieces form a fluidtight chamber within said sump.

2. The assembly as set forth in claim 1, wherein:

a) said liner-forming pieces conform substantially to the inner dimensions of said sump.

3. The assembly as set forth in claim 1, wherein:

a) said liner-forming pieces are constructed of fiberglass.

4. The assembly as set forth in claim 3, wherein:

a) said liner-forming pieces are joined together with fiberglass cloth and fiberglass resin.

5. The assembly as set forth in claim 1, wherein:

a) said liner-forming pieces are joined to the sump by screws.

6. The assembly as set forth in claim 1, wherein:

a) said liner-forming pieces are joined to the sump by adhesive.

7. The assembly as set forth in claim 1, further comprising:

a) a gel-coat layer covering said liner-forming pieces.

8. A method of repairing an underground sump without excavation, comprising the steps of:

a) placing a plurality of liner-forming pieces within an underground sump; and b) joining said liner-forming pieces together to form a fluidtight chamber within said sump.

9. The method as set forth in claim 8, further comprising the step of:

a) applying a layer of gel-coat over said joined liner-forming pieces.

10. The method as set forth in claim 8, further including the step of:

a) joining said liner-forming pieces to conform substantially to the interior dimensions of said sump.

11. The method as set forth in claim 8, further comprising the step of:

a) joining said liner-forming pieces together using fiberglass cloth and fiberglass resin.

12. The method as set forth in claim 8, further comprising the step of:

a) forming an opening in one of said liner-forming pieces which corresponds to a pipe receiving opening in said sump.

13. The method as set forth in claim 8, further comprising the step of:

a) joining a cover support ring to said liner-forming pieces.

14. The method as set forth in claim 13, further comprising the step of:

a) placing a cover on said cover support ring.

15. The method as set forth in claim 8, further comprising the step of:

a) taping said liner-forming pieces together.

* * * * *